United States Patent [19]

Tsuneeda

[11] Patent Number: 4,885,221

[45] Date of Patent: Dec. 5, 1989

[54] ELECTROPHOTOGRAPHY APPARATUS AND ELECTROPHTOGRAPHIC PROCESS FOR DEVELOPING POSITIVE IMAGE FROM POSITIVE OR NEGATIVE FILM

[75] Inventor: Kenichi Tsuneeda, Yokohama, Japan

[73] Assignee: Kabushiki Kaisha Toshiba, Kawasaki, Japan

[21] Appl. No.: 100,756

[22] Filed: Sep. 24, 1987

[30] Foreign Application Priority Data

Dec. 6, 1986 [JP] Japan ..... 61-290805
Dec. 6, 1986 [JP] Japan ..... 61-290806

[51] Int. Cl.[4] ..... G03G 15/01
[52] U.S. Cl. ..... 430/100; 355/268
[58] Field of Search ..... 430/45, 54, 100, 42; 355/268, 267

[56] References Cited

U.S. PATENT DOCUMENTS 3,376,133 4/1968 Roteman ..... 430/100
4,350,749 9/1982 Ohnuma et al. ..... 430/100
4,731,313 3/1988 Haneda ..... 430/42

*Primary Examiner*—John L. Goodrow

*Attorney, Agent, or Firm*—Foley & Lardner, Schwartz, Jeffery, Schwaab, Mack, Blumenthal & Evans

[57] ABSTRACT

An electrophotography apparatus of the present invention includes a movable photoconductive drum capable of carrying an electrostatic latent image on its surface, and a plurality of electrophotographic process means located along a moving direction of the photoconductive drum. A first or second static latent image is formed on the photoconductive drum charged by a main charger, at a first or second exposure radiating portion. In this case, the first and second exposure radiating portions are selectively operated in accordance with whether an original image is a positive or negative film, the first static latent image, formed at the first exposure radiating portion, is reversely developed by a first developing unit, and the second static latent image, formed at the second exposure radiating portion, is normally developed by a second developing unit. An image developed by the first or second developing unit, in accordance with the original image, is transferred onto a recording medium such as paper, by a transfer charger. Any residual transfer developing agent not transferred onto the paper by the transfer charger, but instead remaining on the photoconductive drum, is collected by the first developing unit.

14 Claims, 10 Drawing Sheets

ELECTROPHOTOGRAPHY APPARATUS AND ELECTROPHTOGRAPHIC PROCESS FOR DEVELOPING POSITIVE IMAGE FROM POSITIVE OR NEGATIVE FILM

BACKGROUND OF THE INVENTION

The present invention relates to an electrophotography apparatus and an electrophotographic process and, more particularly, to an improved electrophotography apparatus and electrophotographic process for developing a positive image from a positive or negative film.

Generally, a microfilm is used to record and preserve various images, an electrophotographic process being utilized to record microfilm images on paper.

In an electrophotography unit, light passing through a film is applied onto a photoconductive drum charged by a main charger and rotating in a predetermined direction, thereby to form a static latent image on the drum. This static latent image is developed into a visible image by means of a developing system, and then is transferred onto paper or the like by means of a transfer charger. Thereafter, the paper onto which the image has been transferred is separated from the photoconductive drum by a separation charger.

Residual toner on the surface of the photoconductive drum from which the paper has been separated is removed by a cleaning unit, and any residual charge thereon is discharged by a discharge lamp. Thereafter, the drum is once again charged by the main charger, and the above process is repeated.

Such an electrophotography developing method includes a normal developing method and a reversal developing method. In the case of the former method, toner having a polarity opposite to that of the charge is attracted to a charged portion of the static latent image on the drum, for development to take place. In the case of the latter method, toner having the same polarity as that of a high-potential portion is attracted to an exposed portion of the static latent image on the drum, for development to take place.

In order to ensure that the photoconductive drum can be used repeatedly, it is essential that any residual transfer toner be removed from the drum surface, upon completion of each transfer process. For example, in the case of the normal developing method, if this cleaning process is omitted and a discharging process is performed immediately after the transfer process, the result is as follows:

When the photoconductive drum is used repeatedly, the residual transfer toner becomes charged once again when the next charging process is performed. Then, when a new developing process begins, the residual potential of the drum after exposure ends up being below the developing bias. For this reason, residual toner on the exposed portion does not be removed during development, but instead remains on the drum. Then, when the subsequent transfer process takes place, the toner is transferred from the drum onto the paper, thereby giving rise to ghost images, background fogging, and other flaws, all of which degrade image quality. Therefore, in order to ensure that the photoconductive drum can be used repeatedly, it is essential that a cleaning process be carried out between the image transfer and charging processes.

However, in order to provide a cleaning unit for carrying out the cleaning process, it is necessary that installation space be provided in the electrophotography unit, with the result that the entire unit must be enlarged. In addition, since a cleaning blade now presses against and slides along the drum, the drum is therefore subjected to a degree of mechanical stress, which may cause damage thereto, or result in the toner and other substances being pressed firmly onto the surface of the drum, giving rise to the formation of a film thereon, with the risks that this poses to image quality.

In addition, the residual transfer toner removed by the cleaning unit must be collected in a collecting vessel and discharged when it reaches a predetermined volume, which entails drawbacks as concerns operation efficiency and energy saving.

For the reasons stated above, an apparatus has been manufactured wherein the cleaning unit is omitted and the photoconductive drum is rotated twice in the course of a single image forming process. That is, the developing system is alternately operated for the developing process and the cleaning process during each drum rotation.

For example, when the charging process is performed, the photoconductive drum is uniformly charged to have surface potential $V_0$, and is exposed in the exposing process to form a static latent image. When the developing process is performed, toner having a polarity opposite to that of the charge is attracted to the charged portion of the static latent image by a developing roller biased to have a potential substantially the same as, or slightly higher than, the residual potential of the exposed discharging portion of the drum, whereby development takes place. A powder image thus developed is then transferred to a suitable medium by the transfer charger. Thereafter, the drum is electrically discharged by the discharging lamp and the discharging charger. From the beginning to the end of the entire process, the drum rotates substantially once.

Thus, bias $V_B$ of the developing roller is set such that $0 < V_B < V_0$. In this case, the developing roller also serves as a cleaning unit for removing the residual transfer powder on the drum. In this manner, one recording image is formed while the photoconductive drum rotates twice.

However, such with this type of an apparatus, the circumferential length of the photoconductive drum must be greater than at least the length of the recording image in a process wherein the drum is used repeatedly. In other words, if the circumferential length of the drum is less than the length of the recording image, the trailing end of the image on the drum is still in the developing process when the leading end of the image thereon reaches the position of the developing roller. As a result, the developing roller cannot serve as the cleaning means, and hence the residual transfer powder on the leading end of the image on the photoconductive drum will not be removed therefrom.

For this reason, this apparatus has a drawback in that the circumferential length of the photoconductive drum, and, by inherence, the size thereof, must be increased. In addition, since one of each two rotations is for enabling the cleaning process to be carried out, the usage efficiency of the photoconductive drum is therefore only 50%.

In addition, since the rotation al speed of the drum must be reduced because of the above reasons, it is necessary to provide two bias power sources for applying different biases to the respective developing rollers.

Furthermore, the electrophotography unit can perform the normal and reversal developing methods, both described above incorporates two developing units, these being operated selectively in accordance with the development method (normal development and reversal development) chosen.

A roll is provided within the developing roller of either developing unit. The roll must be rotated by a prescribed angle in order to operate the developing unit. Hence, two driving systems are required for the developing units, respectively, for rotating the rolls. Further, a driving mechanism is required for driving the first developing unit or the second developing unit, thus selecting the normal or reverse developing method. If only one developing unit sufficed, one driving system and the driving mechanism should be unnecessary. In view of this, the conventional electrophorography apparatus is somewhat complicated.

SUMMARY OF THE INVENTION

Accordingly, it is an object of the present invention to provide an electrophotography apparatus and an electrophotographic process for developing a positive image from a positive or negative film.

That is, according to an aspect of the present invention, there is provided an apparatus for forming a positive image on a recording medium from one of a positive and a negative original images, comprises a movable image carrier carrying an electrostatic latent image on the surface thereof; and a plurality of electrophotographic process means located along the moving direction of the image carrier, the electrophotographic process means having (a) charging means for uniformly charging the image carrier, (b) first exposing means for forming a first static latent image on the image carrier, (c) reversal developing means for developing the first static latent image formed by the first exposing means using a first developing agent, (d) second exposing means for forming a second static latent image on the image carrier, (e) normal developing means for developing the second static latent image formed by the second exposing means using a second developing agent, and (f) transferring means for transferring an image developed either by the reversal developing means or the normal developing means on the recording medium in accordance with the type of the original images; wherein the first and second exposing means are selectively operated in accordance with the type of the original image, and the reversal developing means collects a transfer residual developing agent not transferred on the recording medium by the transferring means but left on the image carrier.

According to another aspect of the present invention, there is provided a method for forming a positive image from one of a positive and a negative original images, comprises the steps of: uniformly charging the surface of a movable image carrier carrying an electrostatic latent image on the surface thereof; forming a static latent image including a first portion having a first potential and a second portion having a potential different from that of the first portion on the image carrier; supplying a first developing agent, charged by a first developing means, onto the first portion of the static latent image; supplying a second developing agent charged by a second developing means on the second portion of the static latent image; selectively transferring one of the first and second developing agent deposited on one of the first and second portions of the static latent image onto a recording medium so as to form the positive image in accordance with the type of the original images; uniformly charging the image carrier after one of the first and second developing agent is transferred on the recording medium; and removing the developing agent, left on the image carrier after transfer by the first developing means, simultaneously with fresh supply of the developing agent.

According to still another aspect of the present invention, there is provided an apparatus for forming a positive copy image on a copy sheet from one of a positive and negative original images, comprises: means for uniformly charging the surface of an image carrier, first exposing means for forming a first electrostatic image on the image carrier from the negative original image, reversal developing means for applying developers onto the first electrostatic image formed by the first exposing means: second exposing means for forming a second electrostatic image on the image carrier from the positive original image; normal developing means for applying developers onto the second electrostatic image formed by the second exposing means: means for transferring the developers deposited on the image carrier by one of the reversal developing means and the normal developing means onto the copy sheet so as to form the positive copy image; and means for uniformly exposing the surface of the image carrier after the transfer by the transferring means; and wherein the first and second exposing means are selectively allowed to form one of the first and second electrostatic images in accordance with the type of the original images, and the reversal developing means is adapted for recovering the developers not transferred on the copy sheet but left on the image carrier irrespective of the type of the original images.

According to further aspect of the present invention, there is provided on apparatus for forming a positive image from one of a positive and negative originals comprises: means for forming an electrostatic latent image on a image carrier, the electrostatic latent image including a first portion having a first potential level and a second portion having a second potential level lower than the first potential level; first developing means for applying a first developer charged with a first polarity to the first portion of the electrostatic latent image so as to perform reversal development; second developing means for applying a second developer charged with a second polarity different than the first polarity to the second portion of the electrostatic latent image so as to perform normal development; means for selectively transferring one of the first and second developers on the image carrier onto a recording member so as to form the positive image in accordance with the type of the originals; and means for uniformly charging the developers with the first polarity so that the first developing means removes the residual developers remaining on the image carrier after the transfer by the transferring means.

BRIEF DESCRIPTION OF THE DRAWINGS

These and other features and advantages of the present invention will become more apparent from the following detailed description of exemplary embodiments as illustrated in the accompanying drawings in which.

DETAILED DESCRIPTION OF THE PREFERRED EMBODIMENTS

Preferred embodiments of the present invention will be described below with reference to the accompanying drawings.

Figure 1:
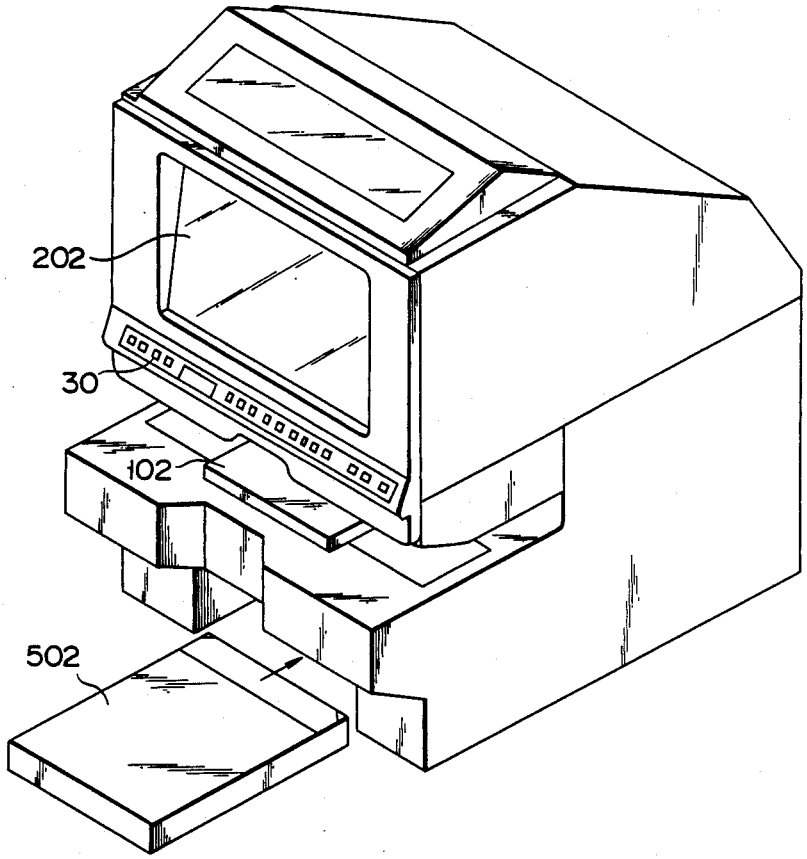
FIG. 1 is a perspective view of an outer appearance of a microfilm reader printer to which an electrophotography apparatus according to an embodiment of the present invention is applied.
Figure 2:
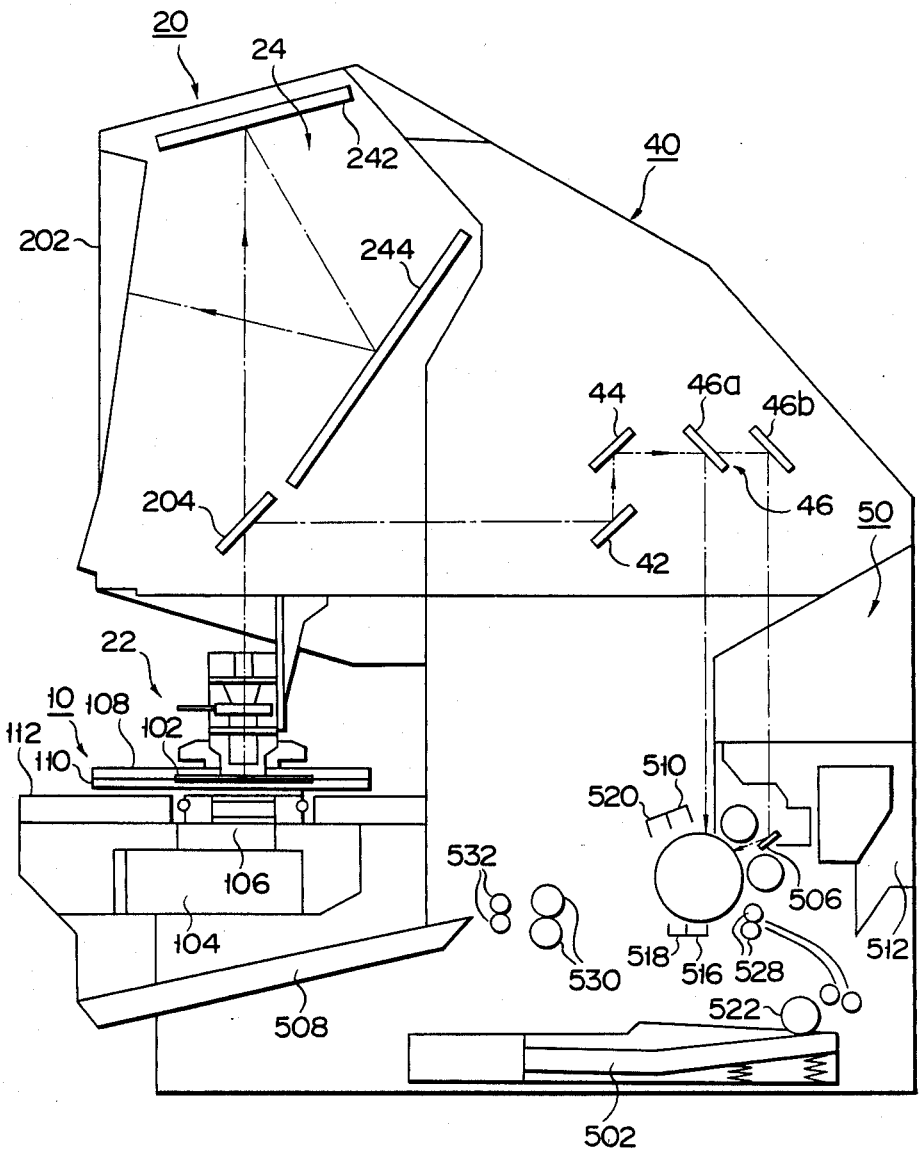
FIG. 2 is a schematic sectional view of the unit shown in FIG. 1.
Figure 3:
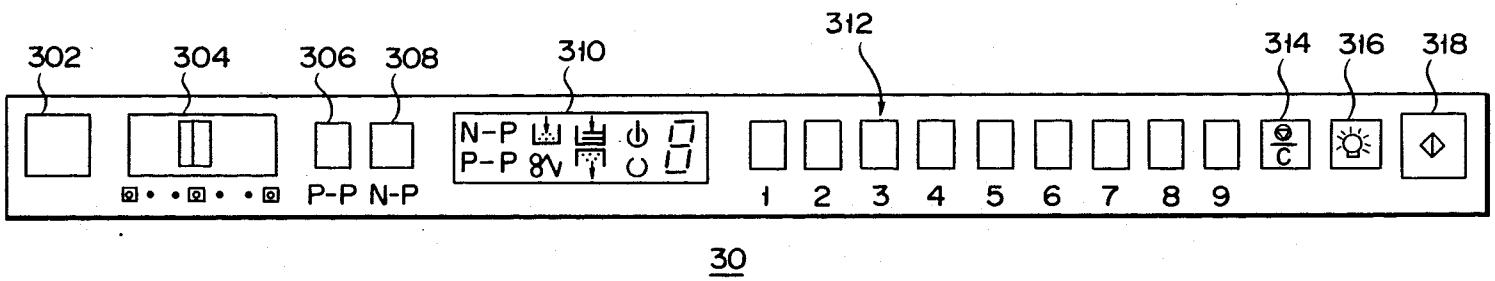
FIG. 3 is a schematic view of an operation panel.

First, referring to FIGS. 1 to 3, a microfilm reader printer to which an electrophotography apparatus and an electrophotographic process of the present invention are applied will be briefly described.

This microfilm reader printer is constituted by film set unit 10 for setting a microfilm, projecting unit 20 for projecting the microfilm, operation panel 30 including various operation keys, scanning light guide unit 40 for guiding scanning light from unit 20, and image forming unit 50 for forming an image on the basis of the scanning light guided by unit 40.

In the microfilm reader printer, film holding plate 102 for sandwiching the microfilm in unit 10, projection screen 202 of unit 20 on which the microfilm is projected in an enlarged scale, and panel 30 are arranged on a front surface. In addition, feed cassette 502 of unit 50 for copying a film can be inserted from the front surface and paper on which a film image is formed can be discharged above an insertion port for cassette 502. For this reason, operations necessary for projecting and copying a microfilm can be performed at the front side of the reader printer main body.

Panel 30 includes main switch 302, light adjusting volume 304, and keys for selecting development of either positive to positive (to be referred to as P → P hereinafter) or negative to positive (to be referred to as N → P hereinafter) when an image recorded on a positive or negative microfilm is to be developed as a positive image, i.e., P → P development selecting key 306 and N → P development selecting key 308. Panel 30 also includes display keyboard 310 on which various pieces of information are displayed, copy number set key 312 for selecting and setting the number of copies, clear/stop key 314, standby key 316, and copy start key 318.

On keyboard 310, N → P, P → P, toner replenishment, paper jamming, copy standby, copy enable, and copy number information are displayed on the basis of signals from various sensors. Switch 302 is a switch for starting driving of the microfilm reader printer. When switch 302 is turned on, light source 104 in unit 10 is turned on to enable projection and a heater in unit 50 is also turned on.

When key 316 is turned on, only source 104 is turned off. That is, since warm-up of the heater in unit 50 takes a long time, source 104 is turned off during warm-up to eliminate useless projection. If source 104 is turned on for a long time, a temperature is increased and a life of source 104 is largely reduced. Key 316 can eliminate these drawbacks.

An internal arrangement of the microfilm reader printer comprises unit 10 having plate 102 on its upper surface and incorporating source 104 for projection therebelow, unit 20, unit 40 for guiding scanning light from pivot mirror 204 in unit 20, and unit 50 for forming an image on a recording medium in cassette 502 on the basis of the scanning light from unit 40. Note that units 10 and 20 constitute a projecting means, and mirror 204 and unit 40 constitute a scanning means.

Arrangements and operations of units 10, 20, 30, 40, and 50 will be described below.

First, unit 10 will be described. Unit 10 is constituted by plate 102, source 104, and condenser lens 106 arranged above source 104. Light from source 104 is radiated on a microfilm held in plate 102 through lens 106. That is, since a life of source 104 is relatively short and is further reduced when source 104 is manually repeatedly turned on/off, lens 106 is used to increase the life of source 104.

Plate 102 has a pair of transparent plates and holds a microfilm therebetween. In addition, plate 102 can be moved back and forth or sideway on a plane above lens 106 by operating handle 108 shown in FIG. 2. Pointer 110 is formed in handle 108 to be movable on coordinates formed on front panel 112. Therefore, when a microfilm recording a plurality of pieces of information is held in plate 102, pointer 110 is moved along the coordinates by operating handle 108, and desired information is set above lens 106 in accordance with the coordinates.

Note that when a roll-like microfilm is to be set, plate 102 and an associated unit can be replaced, so that various types of microfilms can be set. During replacement of this unit, source 104 is turned off in accordance with an output from a sensor (not shown) for detecting the presence/absence of the unit. This is because it is useless to perform projection when the unit is detached and because a light leakage occurs.

An arrangement and an operation of unit 20 will be described below.

Unit 20 comprises lens holder section 22 and screen projector section 24. Holder section 22 performs focus adjustment of a projected image and rotation adjustment of the projected image onto screen 202. Holder section 22 is located above source 104.

Projector section 24 displays a projected image on screen 202 on the basis of projecting light incident through holder section 22. In projector section 24, first and second mirrors 242 and 244 are used in addition to screen 202 to sequentially reflect an image and project it on screen 202. Note that mirror 204 is arranged at an incident end of projector section 24 to be reciprocable along a direction from the front surface to the rear surface of paper of FIG. 2 and an inclination angle of its mirror surface can be varied.

Upon projection onto screen 202, mirror 204 is stopped at a position separated from above holder section 22 so as not to prevent incidence to mirror 242. When copying is performed in unit 50, mirror 204 is arranged above holder section 22, and the inclination angle of the mirror surface is varied, thereby sequentially scanning the projecting light and guiding it to subsequent unit 40. Note that reciprocation of mirror 204 is driven by a motor (not shown).

Unit 40 guides the scanning light reflected by mirror 204 so that the light is imaged on photoconductive drum 504 in unit 50. Unit 40 is constituted by third, fourth, and fifth mirrors 42, 44, and 46. Of mirrors 42, 44, and 46, mirror 46 can be horizontally moved as shown in FIG. 2 in which reference numeral 46*a* denotes a set position used in N → P development; and 46*b*, a set position used in P → P development. Positive image exposure light is guided on the photoconductive drum through sixth mirror 506 set in unit 50.

An arrangement and an operation of unit 50 according to the first embodiment will be described below.

Figure 4:
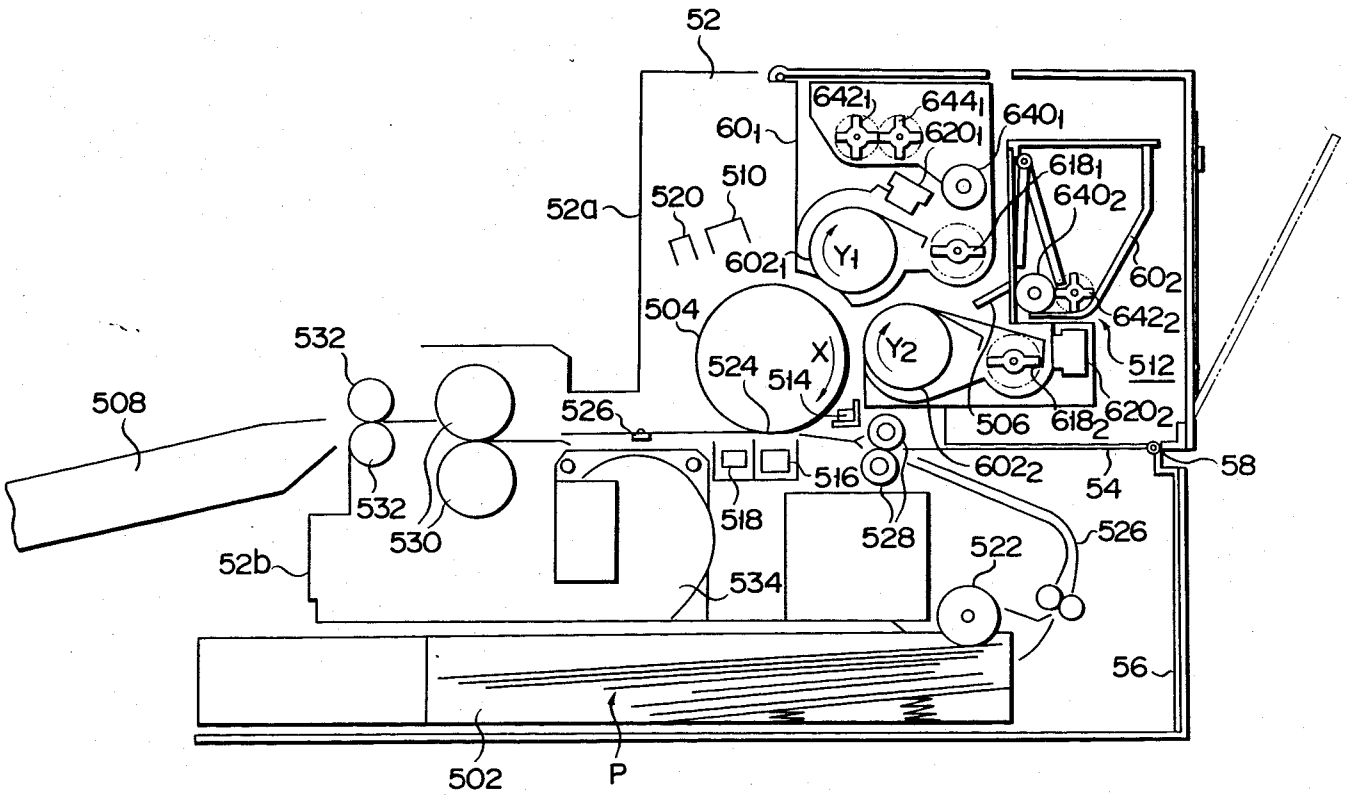
FIG. 4 is a schematic sectional view of an image forming unit.

FIG. 4 is a schematic sectional view of unit 50 according to the first embodiment. In FIG. 4, feed cassette 502 having paper P therein is mounted on a bottom surface side of main body 52 of unit 50, and receiving tray 508 is mounted on a left side surface (a front side of the microfilm reader printer) thereof. Drum 504 as an image carrier is set at substantially the center of body 52. Main charger 510 as a charging means, developing system 512, pre-transfer discharge unit 514, transfer charger 516 as a transfer means, separation charger 518, and discharge lamp 520 are sequentially disposed around drum 504.

Paper transport path 526 for guiding paper P automatically picked up from cassette 502 through feed roller 522 to receiving tray 508 through image forming section 524 between drum 504 and transfer charger 516 is set at a lower portion of body 52. Resist rollers 528 are disposed at the upstream side of section 524 along path 526, and heat-rollers 530 and exit rollers 532 are disposed at the downstream side thereof.

When drum 504 is driven in a direction indicated by arrow X in FIG. 4, the surface of drum 504 is uniformly charged by main charger 510, and scanning light from unit 40 is sequentially imaged on drum 504 to form a static latent image. The static latent image thus formed is developed by system 512 to be visualized and the paper is fed toward transfer charger 516.

Paper P supplied by cassette 502 is separated from drum 504 by separation charger 518 and then guided to heat-rollers 530 through path 526. After a transferred image is melted and fixed on paper P by heat-rollers 530, paper P is discharged to tray 508 by rollers 532. A residual charge on drum 504 after the image is transferred on paper P is erased by discharge lamp 520, and transfer residual toner is removed simultaneously with development according to the first embodiment, thereby preparing for the next copying operation.

Upper frame 54 and lower frame 56 of body 52 are pivotally supported by support shaft 58 at one end portions thereof. Main charger 510, system 512, discharge lamp 520, and the like are mounted on frame 54 by proper means to surround drum 504, thereby constituting upper unit 52*a*. Cassette 502, transfer charger 516, separation charger 518, heat-rollers 530, rollers 532, tray 508, and the like are mounted on frame 56 by proper means, thereby constituting lower unit 52*b*.

Frame 54 can be opened/closed substantially along path 526 by pivoting it around shaft 58 (this arrangement is also called a "clamshell structure"). For this reason, jammed paper can be easily removed and maintenance can be conveniently performed.

System 512 in unit 50 will be described below.

Figure 5:
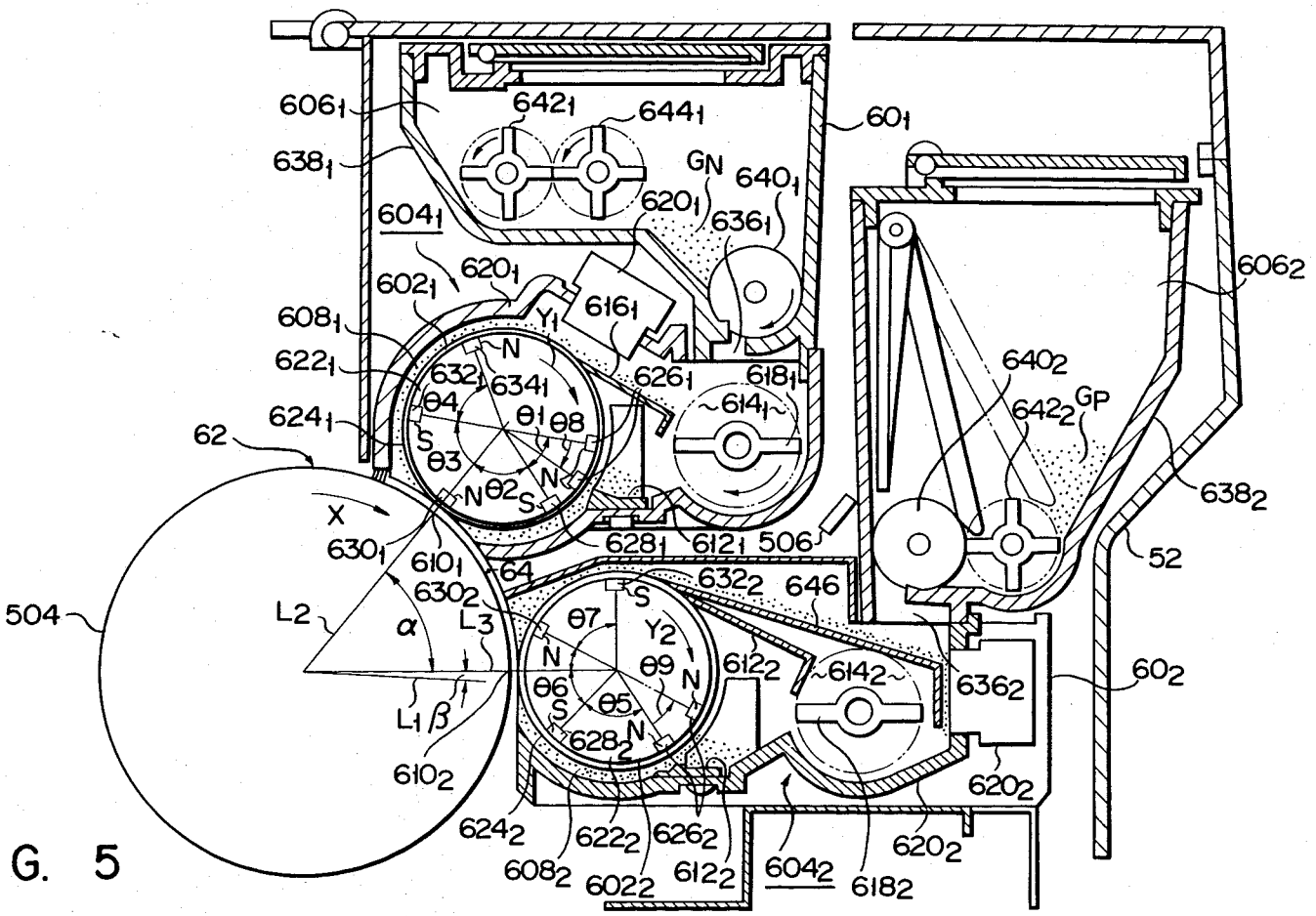
FIG. 5 is a schematic sectional view of a developing system shown in FIG. 4.
Figure 6:
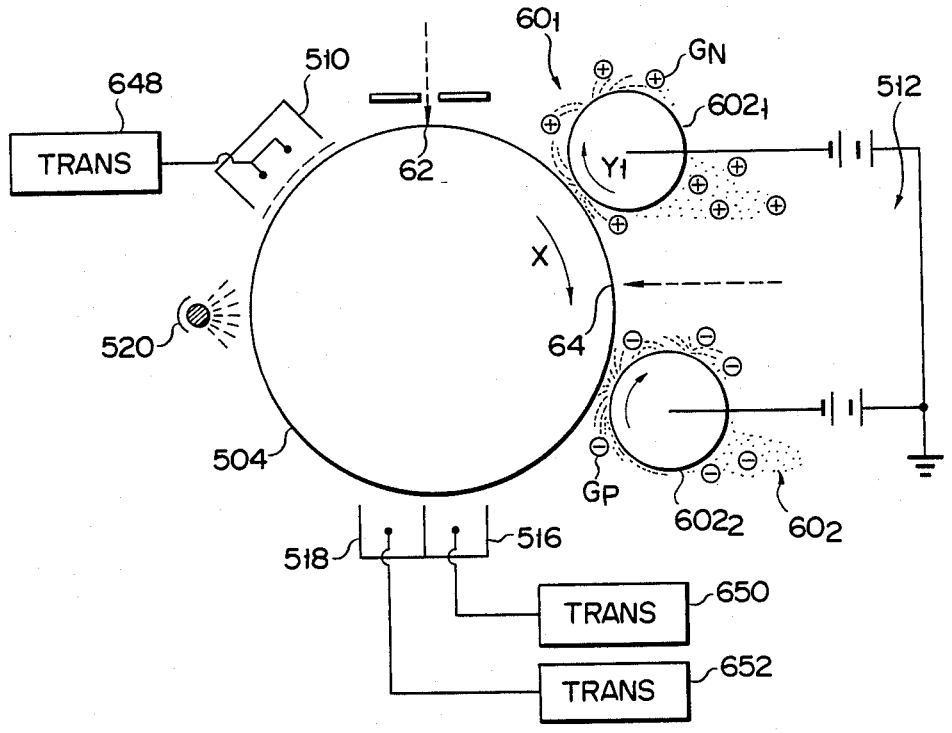
FIG. 6 is a view for explaining an operation of the present invention in which a periphery of a photoconductive drum is shown.

Referring to FIGS. 5 and 6, developing system 512 includes first developing unit $60_1$ and second developing unit $60_2$. Units $60_1$ and $60_2$ respectively have first developing roller $602_1$ and second developing roller $602_2$ respectively rotatable along directions indicated by arrows $Y_l$ and $Y_2$. By selectively driving roller $602_2$, both the negatively and positively recorded microfilms can be developed as positive images.

That is, in system 512, unit $60_1$ performs development from positive to negative and cleaning of the transfer residual toner on drum 504, and unit $60_2$ performs development from negative to positive.

First exposure radiating section 62 is formed on the upper portion of drum 504, and second exposure radiating section 64 is formed between rollers $602_1$ and $602_2$. Sections 62 and 64 respectively represent exposure positions of N → P development and of P → P development and are operated in accordance with the set position of mirror 46.

Unit $60_1$ also has first developing mechanism section $604_1$ and first toner replenishing section $606_1$. Section $604_1$ is provided at the upstream side of roller $602_1$ and a sliding contact portion of first developing agent magnetic brush $608_1$ with respect to drum 504, i.e., first development position $610_1$. First doctor $612_1$ for regulating a thickness of brush $608_1$, first scraper $616_1$ provided at the downstream side of position $610_1$, for scraping brush $608_1$ on the surface of roller $602_1$ and guiding it to first developing agent housing section $614_1$, and first developing agent agitator $618_1$ housed in section $614_1$, are housed in first casing $620_1$. Note that first developing agent density detector $620_1$ for detecting the developing agent density by magnetically detecting changes in permeability of toner $G_N$ is mounted at a position corresponding to an upper portion of roller $602_1$ of casing $620_1$.

Roller $602_1$ is constituted by first magnetic roll $622_1$ and first sleeve $624_1$. The center of first magnetic roll $622_1$ is positioned on straight line $L_2$ extending through a rotation center of drum 504 and having angle $\alpha$ (about 51° ) with respect to horizontal line $L_1$. First sleeve $624_1$ is fitted on roll $622_1$ and rotates clockwise.

Roll $622_1$ has five magnetic pole sections $626_1$, $628_1$, $630_1$, $632_1$, and $634_1$, of which sections $626_1$, $630_1$, and $634_1$ are N-poles, and sections $628_1$ and $632_1$ are S-poles. Angles between the respective sections are set such that angle $\theta_1$ between sections $626_1$ and $628_1$ is about 50° , angle $\theta_2$ between sections $628_1$ and $630_1$ is about 71° , angle $\theta_3$ between sections $630_1$ and $632_1$ is about 60° , and angle $\theta_4$ between sections $632_1$ and $634_1$ is about 60° .

First toner replenishing section $606_1$ has first hopper $638_1$, first hopper replenishing port $636_1$ of which faces to first developing agent housing section $614_1$ of first developing mechanism section $604_1$, first toner replenishing roller $640_1$ provided in hopper $638_1$ to close port $636_1$, and a pair of agitating rollers $642_1$ and $644_1$ for agitating toner $G_N$ in hopper $638_1$ to convey toner $G_N$ toward roller $640_1$.

Second developing unit $60_2$ has substantially the same basic arrangement as that of first developing unit $60_1$. Differences between units $60_2$ and $60_1$ are a shape of second hopper $638_2$ of second toner replenishing port $636_2$, an arrangement of magnetic poles of second magnetic roll $622_2$ of second developing roller $602_2$, and a mounting position of second developing agent density detector $620_2$. In addition, in unit $60_2$, third scraper 646 which is narrow (about 50-mm wide) and has an inclination of about 20° is additionally provided, and toner $G_P$ is agitated by single agitating roller $642_2$. For this reason, the other same parts are denoted by the same reference numerals, suffixes of which are changed from "1"to "2", and a detailed description thereof will be omitted.

Second magnetic roll $622_2$ of roller $602_2$ has four magnetic pole sections, of which sections $626_2$ and $630_2$ are N-poles, and sections $628_2$ and $632_2$ are S-poles. Angles between the respective sections are set such that angle $\theta_5$ between sections $626_2$ and $628_2$ is about 78°, angle $\theta_6$ between sections $628_2$ and $630_2$ is about 70°, and angle $\theta_7$ between sections $630_2$ and $632_2$ is about 80°. The center of roll $622_2$ is positioned on straight line $L_3$ extending through the center of drum 504 and having angle $\beta$ (about 1°) with respect to horizontal line $L_1$.

In addition, roll $622_2$ of unit $60_2$ can be pivotally displaced through a pivoting angle of about 25°, and along with this pivotal displacement, forms or removes second developing agent magnetic brush $608_2$ on or from the surface of roller $602_2$. By switching roll $622_2$ of unit $60_2$ to a predetermined position by magnetic roll driving means, brush $608_2$ is formed only on the surface of roller $602_2$.

That is, when N → P development is to be performed, roll $622_1$ of unit $60_1$ is displaced clockwise through about 25° ($\theta_8$) from a position where section $630_1$ opposes position $610_1$ to a position where section $626_2$ opposes second doctor $612_2$, so that no magnetic brush is formed (not shown).

When P → P development is to be performed, unit $60_2$ is operated, roll $622_2$ of unit $60_2$ is pivotally displaced counterclockwise through about 25° ($\theta_9$) from a position shown in FIG. 5, so that doctor $612_2$ is positioned at substantially the intermediate portion between sections $626_2$ and $628_2$, although not shown. As a result, brush $608_2$ is formed on the surface of roller $602_2$ of unit $60_2$.

Note that when section $626_2$ of roll $622_2$ of unit $60_2$ opposes doctor $612_2$ using a nonmagnetic material, brush $608_2$ is no longer formed on the surface of roller $602_2$. This is because a force of attracting toner $G_P$ at section $626_2$ is weakened and hence can be easily regulated by doctor $608_2$ since density of the magnetic brush thereat is sparse. For this reason, if second sleeve $624_2$ rotates, toner $G_P$ does not pass through doctor $612_2$.

Image forming unit 50 will be described in detail below.

As shown in FIGS. 4 to 6, unit 50 has first and second developing rollers $602_1$ and $602_2$. Rollers $602_1$ and $602_2$ are alternatively switched to be driven in accordance with N → P and P → P developing modes to be described later.

In developing system 512, first developing unit $60_1$ performs N → P development, i.e., so-called reversal development and houses a two-component developing agent including toner $G_N$ having the same polarity as that of main charger 510 and a magnetic material such as an iron powder or ferrite. On the other hand, second developing unit $60_2$ performs P → P development, i.e., so-called normal development and houses a developing agent similar to that described above and including toner $G_P$ having a polarity opposite to that of unit $60_1$. Main charger 510, transfer charger 516, and separation charger 518 are applied with predetermined voltages by charge transformer 648, transfer transformer 650, and separation transformer 652, respectively.

The above-mentioned two-component developing agent will be described below.

For example, assume that the first carrier and first toner of the reversal developing agent (N → P) in unit $60_1$ are denoted by $C_1$ and $G_1$, respectively. In this triboelectrification, toner $G_1$ must be positively charged to have an electron donor property, and carrier $C_1$ must be charged to have an electron acceptor property. On the other hand, assume that the second carrier and second toner of the normal developing agent (P → P) are denoted by $C_2$ and $G_2$. In this triboelectrification, contrary to the reversal developing agent, the normal developing agent exhibits the electron acceptor property and is negatively charged. That is, carrier $C_2$ is charged to have a positive polarity. Second toner $G_2$ must have the electron donor property, i.e., the positive polarity in triboelectrification with respect to first carrier $C_1$.and must have the electron acceptor property, i.e., the negative polarity in triboelectrification with respect to second carrier $C_2$. The reason for this is as follows.

More specifically, in the case of an image output of P → P, the normal developing agent (unit $60_2$) is used, and toner $G_2$ left on photoconductive drum 504 after transfer is charged again in the next cycle to have the positive polarity and removed by unit $60_1$. In this case, in unit $60_1$, if, due to the friction with first carrier $C_l$, toner $G_2$ becomes negatively charged toner exhibiting the electron acceptor property like second carrier $C_2$, masses of toners $G_l$ and $G_2$ having different polarities are generated in unit $60_1$. Therefore, in the case of an image output of N → P using first toner $G_l$, image degradation such as a fog or image unevenness occurs.

For this reason, according to the polarities of the toners and the carriers set as describe above, carrier $C_2$ has the same polarity as that of toner $G_l$ since toner having the electron donor property, i.e., the positive polarity can be obtained in triboelectrification with respect to carrier $C_l$. Therefore, problems such as degradation in image quality are not posed.

In addition, it is preferred that toners $G_l$ and $G_2$ are in the same position in a triboelectrification series, i.e., are the same toner and have the electron donor property with respect to carrier $C_l$ and the electron acceptor property with respect to carrier $C_2$ in triboelectrification with respect to carriers $C_l$ and $C_2$.

As a method of controlling triboelectrification between the toners and the carriers as described above, the toners and the carrier will be described below.

The toner includes base resin (80 to 95 wt%) such as a styrene-acrylic copolymer as a base, and a pigment (5 to 15%) such as carbon black or a fluidizing agent such as colloidal silica. Since control of charge of the toner by selection of these materials is limited by inherent objects of the materials, it is primarily performed by addition of a charge controlling agent (1 to 10%).

For positive charging, a pigment having the electron donor property such as a nigrosine dye containing basic nytrogen is effective, and a fatty amine, a quaternary ammonium salt, a compound of the quaternary ammonium salt and a higher alkyl group, a simple substance compound of phosphorus or tungsten, a molybdic acid chelating material fluorine activator, and hydrophobic silica may be used.

For negative charging, materials containing a polar group having high electronegativity such as an organic complex salt, e.g., a dissolved-alloy dye, chlorinated polyolefin, chlorinated polyester, a sulfonyl amine of copper phthalocyanine, an azooil black chromium alloy, and a dimer having a nitro group may be used.

As for the carrier, nickel ferrite generated from manganese oxide and iron oxide may be used. Alternatively, ferrite of, e.g., copper and magnesium lead may be used as a core and coated with a resin and the resin may be imparted a charge controlling function. The resin for coating the ferrite core may be selected from fluoroplastics, acrylic resin, a copolymer resin of styrene and acryl, silicone resin, polyester resin, and polybutadiene resin. A material as the charging controlling agent of the toner as described above is added to the resin, thereby controlling charging of the toner.

By charging control with respect to the toners and the carriers, the toners and the carriers are preferably arranged in the triboelectrification series as described above to obtain a two-component developing agent including the reversal and normal developing agents.

In system 512 having the above arrangement, electrophotographic processes of P → P development and N → P development will be described below with reference to FIGS. 1 to 9. Note that in the same process, symbol $_n$ is used to represent a multicopying operation.

Figure 7A:
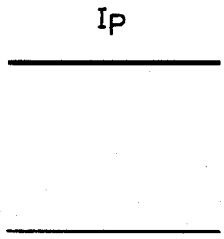
FIGS. 7A to 7H are schematic views for explaining an operation of the present invention in a case of developing a positive image from a positive film.
Figure 7B:
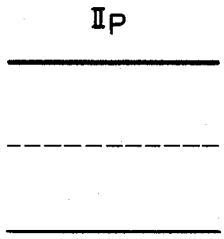
Figure 7C:
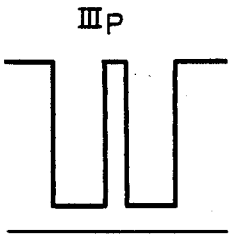
Figure 7D:
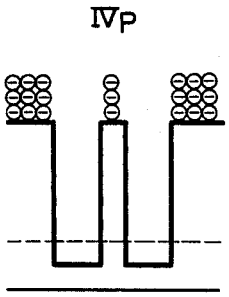

First, P → P development will be described. Key 306 on panel 30 is depressed to set a P → P development mode. When P → P development is started, like process $I_P$ shown in FIG. 7A, the surface of drum 504 of, e.g., A-Se is uniformly and positively charged to have a surface potential of 700 V by transformer 648 using charger 510. Thereafter, light is not radiated at first exposure radiating section 62, and first development in process $II_P$ of FIG. 7B is performed in an unexposed state. In this first development, a bias voltage of about 400 V is applied to roller $602_1$ of unit $60_1$, and the magnetic brush is brought into contact with drum 504.

As described above, charged drum 504 is not exposed and hence can undergo process $II_P$ while its surface potential remains at 700 V. In this state, in process $III_P$ of FIG. 7C, a latent image is formed on drum 504 by exposure at second exposure radiating section 64.

Figure 9A:
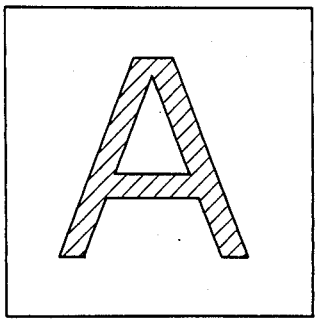
FIGS. 9A and 9B are views respectively of positive and negative microfilm images.

For example, projecting light (scanning light) with respect to a positive microfilm shown in FIG. 9A attenuates the surface potential of a portion on drum 504 corresponding to a portion other than character "A", and only the surface potential of a portion on drum 504 corresponding to the character "A" is left unchanged. As a result, a static latent image corresponding to the character "A" on the microfilm is formed. Thereafter, in process $IV_P$ shown in FIG. 7D, the image is visualized by unit $60_2$. In second development of process $IV_P$, normal development is performed contrary to first development of process $II_P$. Therefore, a developing bias of about 200 V is applied and set to roller $602_2$.

In this case, the toner and the carrier in unit $60_2$ are the same as those in unit $60_1$ and adjustment is performed in accordance with the triboelectrification series of both the materials such that the carrier has a positive polarity and the toner has a negative polarity, thereby performing normal development in which development is performed to a high potential portion of drum 504.

Figure 7E:
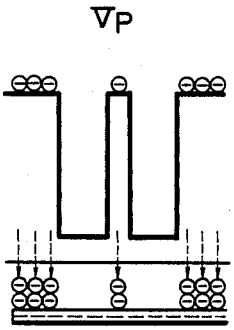

After process $IV_P$, process $V_P$ shown in FIG. 7E is performed.

Paper P supplied from cassette 502 is synchronized by rollers 528 and guided to transfer charger 516. In process $V_P$, the toner visualized by normal development in process $IV_P$, i.e., the toner having the negative polarity is transferred on paper P by applying a corona charge having the positive polarity of transfer charger 516 by transformer 650 with an applied voltage of D.C. 5.0 kV.

Figure 7F:
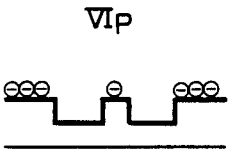
Figure 7G:
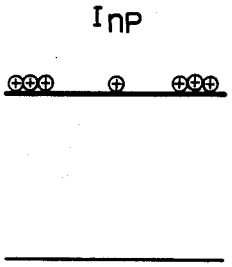

In process $VI_P$ shown in FIG. 7F, the surface of drum 504 is irradiated by lamp 520 through transfer residual toner to attenuate the potential of drum 504, thereby initializing it. Thus, the process of P → P, i.e., copying process of one cycle is completed.

A copying process in the next cycle will be described below. After initialization in process $VI_P$, a charged corona is applied on drum 504 so that surface potential $V_0$ of drum 504 is uniformly charged to be about 700 V again. At this time, the transfer residual toner of the negative polarity is inverted to have the positive polarity (process $I_{nP}$) since the charged corona has the positive polarity. As a result, the transfer residual toner of the positive polarity is present on drum 504 having a surface potential of 700 V. In addition, since the image is unexposed in process $III_P$ as described above, an operation advances to first development in process $II_{nP}$ shown in FIG. 7H.

Figure 7H:
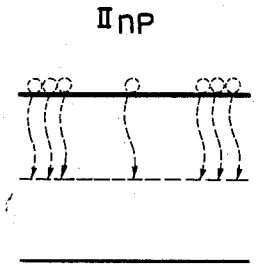

When the operation advances to first development in process $II_{nP}$, an electric field is generated between the surface potential of 700 V of drum 504 and the bias potential 400 V of roller $602_1$. In this case, both the transfer residual toner adhered on the high potential portion of the static latent image and the surface potential of drum 504 have the positive charge. For this reason, in accordance with a relationship between repulsion of the same polarity and the electric field, the residual toner represented by a broken line in FIG. 7H is removed.

Thus, the transfer residual toner adhered on the high potential portion of the photoconductive body is entirely removed in unit $60_1$. After process $II_{nP}$, the operation advances to process $III_P$. In this case, electrophotographic processes in a series of P → P development are sequentially repeated in the order of $I_P \rightarrow IIP \rightarrow IIIP \rightarrow IVP \rightarrow VP \rightarrow VIP \rightarrow InP \rightarrow IInP \rightarrow IIIp \rightarrow IVp \ldots$, thereby outputting an image of P → P.

Figure 8A:
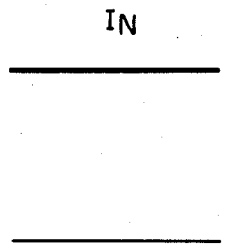
FIGS. 8A to 8I are schematic views for explaining an operation of the present invention in a case of developing a positive image from a negative film.
Figure 8B:
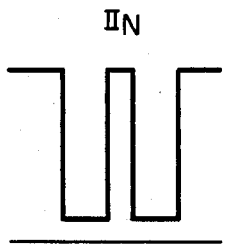
Figure 9B:
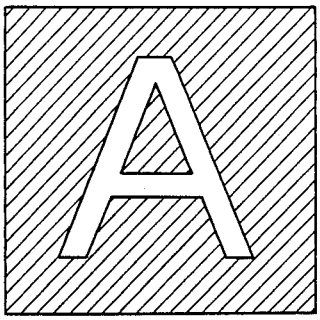
Figure 10:
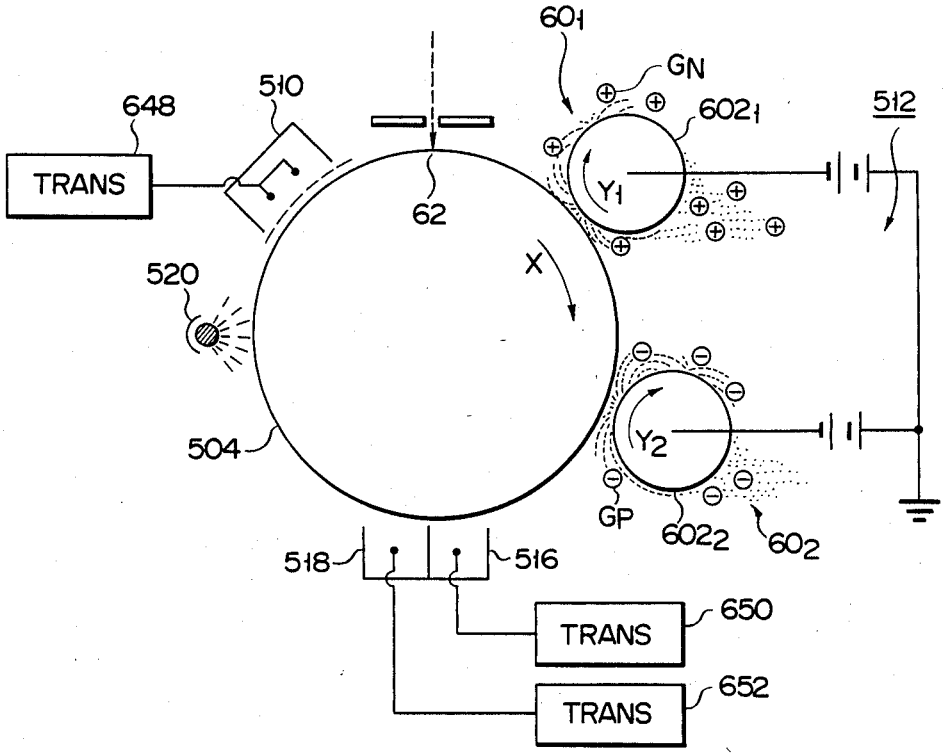
FIG. 10 is a view for explaining an operation according to a second embodiment of the present invention in which a periphery of the photoconductive drum is shown.

N → P development will be described below. Similar to P → P development, key 308 on panel 30 is depressed to set an N → P mode. In process $I_N$ shown in FIG. 8A, the surface of drum 504 is uniformly and positively charged to obtain the surface potential of 700 V. Then, in exposure in process $II_N$ shown in FIG. 8B, projecting light (scanning light) with respect to a negative microfilm shown in FIG. 9B is radiated only on a portion of drum 504 corresponding to character "A" by first exposure radiating section 62. Therefore, the surface potential on drum 504 is attenuated in correspondence to a portion other than character "A", and the surface potential of a portion on drum 504 corresponding to character "A" is left changed. As a result, a static latent image corresponding to character "A" is formed as shown in FIG. 8B.

Figure 8C:
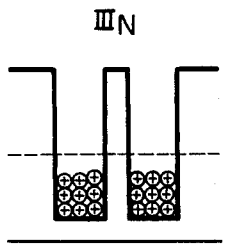
Figure 8D:
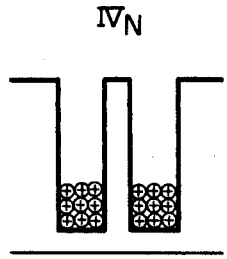

A bias voltage of 400 V is applied to roller $602_1$, and adjustment is performed in accordance with the triboelectrification series of the toner and the carrier in unit $602_1$ such that the carrier has the negative polarity and the toner is positively triboelectrified to have the positive polarity. The toner transported along the surface of roller $602_1$ together with the carrier is attracted on the surface of drum 504 by the Coulomb force, and the static latent image is visualized by reversal development as shown in FIG. 8C (process $III_N$).

In this case, second exposure radiating section 64 for P → P is formed between rollers $602_1$ and $602_2$. For this reason, the operation advances to process $IV_N$ shown in FIG. 8D while drum 504 is unexposed. In process $IV_N$, a developing agent magnetic brush is not formed since roll $622_2$ in unit $60_2$ is pivoted, drum 504 passes through in a noncontacting state without disturbing the image visualized in process $III_N$ by unit $60_2$.

Figure 8E:
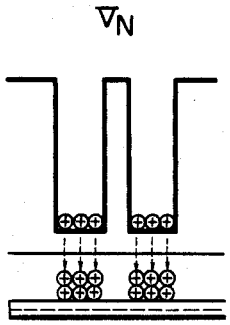

Process $V_N$ shown in FIG. 8E is a transfer process in which paper P is synchronized by rollers 528 as in P → P development described above. In process $V_N$, the toner visualized by reversal development, i.e., the toner having the positive polarity is transferred on paper P by applying a corona charge having the negative polarity of transfer charger 516 from transformer 650 with an applied voltage of about D.C, −5.4kV. Thereafter, paper P is separated from drum 504 at separation charger 518 by transformer 652. Separated paper P is guided to heat-rollers 530, and a transferred image is melted and fixed thereat, thereby forming an image of N → P development.

Figure 8F:
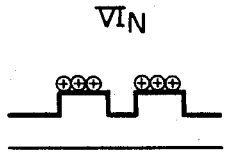

The operation advances to discharging process $VI_N$ shown in FIG. 8F while the transfer residual toner not transferred but left on the surface of drum 504 in process $V_N$ of FIG. 8E is kept adhered thereon. In process $VI_N$, light of a wavelength having sensitivity in terms of spectral sensitivity of a photoconductive body such as an LED is radiated through the transfer residual toner. The light from lamp 520 is radiated on drum 504 through gaps between the individual transfer residual toner particles to substantially erase the static latent image on drum 504.

Thus, a copying process of one cycle according to N → P development is performed, and a copying process in the next cycle is performed as follows.

Figure 8G:
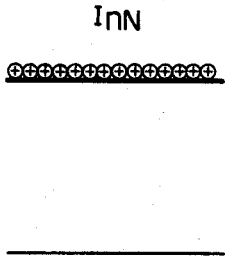

After process $VI_N$, the operation advances to process $I_{nN}$ shown in FIG. 8G, and a charged corona is applied on drum 504 as in process $I_N$ to uniformly charge surface potential $V_0$ on drum 504 to be about 700 V. In this case, the transfer residual toner is charged toward the positive polarity up to a saturation charge amount. The surface of drum 504 is charged by the corona charge along gaps between the transfer residual toner particles. That is, the transfer residual toner having the positive polarity is present on drum 504 having the surface potential of 700 V. In process $II_{nN}$ shown in FIG. 8H, similar to process $VI_N$ of FIG. 8F, the surface of drum 504 is irradiated through the individual transfer residual toner particles as in process $II_N$, thereby forming a static latent image.

Figure 8H:
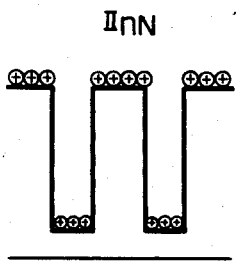
Figure 8I:
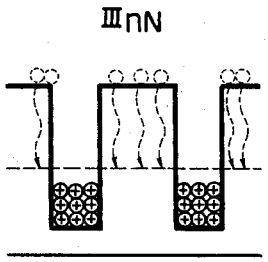

When the operation advances to first development in process $III_{nN}$ as shown in FIG. 8I, an electric field is formed between the surface potential of 700 V of drum 504 and the bias potential of 400 V of roller $602_1$, as in P → P development. Since both the transfer residual toner adhered on the high potential portion of the static latent image and the surface potential of drum 504 have the positive charge, they are placed under the influences of repulsion of the same polarity and the electric field, so that the residual toner represented by a broken line in FIG. 8I is removed.

The transfer residual toner left on the potential attenuating portion of the static latent image is subjected to reversal development simultaneously with cleaning of the transfer residual toner in unit $60_1$ during process $III_{nN}$. Therefore, the transfer residual toner are mixed by development of fresh toner, thereby posing no problem.

That is, after process $III_{nN}$, the operation advances to process $IV_N$ again, and a series of electrophotographic processes are sequentially repeated in the order of $I_N \rightarrow IIN \rightarrow IIIN \rightarrow IVN \rightarrow VN \rightarrow VIN \rightarrow InN \rightarrow IInN \rightarrow IIInN \rightarrow IVN \rightarrow VN$, thereby outputting an image of N→ P.

Note that in, e.g., FIGS. 8F and 8H, the light is radiated through the transfer residual toner particles. In this case, since transfer efficiency is about 80% when image reflecting density ID =1.0, an amount of the transfer residual toner is as small as about 0.05 mg/cm$^2$ at most. Therefore, if the light is radiated on drum 504 through the transfer residual toner particles, almost no problem is posed.

When normal development and reversal development are reversed with each other, the corona charge of charger 510 and the transfer residual toner have the opposite polarities, so that the transfer residual toner is inverted by the corona charge to have the same polarity as that of the corona charge on drum 504.

In the microfilm reader printer of this embodiment, when development is performed in either of P → P development and N → P development modes to perform the switching operation of transfer charger 516 for P → P development and N→ P development, selection cannot be performed by keys 306 and 308 on panel.

An overall operation of the microfilm reader printer of the above embodiment will be briefly described below.

First, a film projecting operation will be described. During film projection, handle 108 is pulled toward an operator to open the upper transparent plate of plate 102, thereby setting a microfilm between the transparent plates. Then, switch 302 on panel 30 is depressed to turn on light source 104 for projecting, so that an enlarged image of the microfilm can be observed. Note that focus adjustment is performed by rotation by a focus adjusting member formed outside lens holder section 22, and positioning of a projected image is performed by moving handle 108 back and forth or sideway while viewing screen 202 or coordinates on panel 112 designated by pointer 110. In addition, by rotating an adjusting gear of the lens as needed, the projected image on screen 202 can be easily rotated.

An operation of copying an enlarged image of the microfilm on paper P in cassette 502 will be described below. In this case, assume that copy standby information is displayed on keyboard 310 on panel 30. Key 316 is turned on to turn off source 104, and the operator waits for warm-up of the heater in unit 50. During warm-up of the heater, an operation button (not shown) is depressed to move mirror 204 in a direction from the rear surface to the front surface of paper of FIG. 2, thereby setting mirror 204 above holder section 22. When warm-up of the heater is completed and copy enable information is displayed on keyboard 310, key 316 is turned off. Then, either of keys 306 and 308 is selected in accordance with the type of an image of the microfilm. Thereafter, a desired copy number is selected by key 312, and key 318 is depressed to start the copying operation.

As a result, the projecting light is scanned by mirror 204 which is rotated in synchronism with rotational driving of drum 504 in the X direction. At this time, mirror 46 in guide unit 40 is set at a position corresponding to the mode selected by either of keys 306 and 308. That is, in the case of N → P development, the projecting light is radiated on first exposure radiating portion 62 on drum 504 through the fifth mirror at a position of 46*a*, and in the case of P → P development, the light is radiated on second exposure radiating portion 64 on drum 504 through the fifth mirror at a position of 46*b* and mirror 506.

Drum 504 is charged by charger 510, and a static latent image is formed in accordance with the scanning light. Thereafter, when drum 504 moves to a position opposing system 512, a positive developing agent image is formed by unit $60_1$ with respect to a latent image based on the negative microfilm. On the other hand, with respect to the latent image based on the positive microfilm, a positive developing agent image is formed by unit $60_2$. This developing agent image is transferred on paper P in accordance with P → P development and N → P development by charger 516. Paper P on which the image is transferred is separated from drum 504 by charger 518. Then, paper P is guided to heat-rollers 530 through path 526, and the transferred image is melted and fixed thereat. Thereafter, paper P is discharged by exit rollers 532 to tray 508 at the front side of the microfilm reader printer.

After a residual image on drum 504 is erased by lamp 520, the residual toner left on drum 504 is charged and drum 504 is charged therethrough by main charger 510. Then, the residual toner is removed by unit $60_1$ in a copying operation in the next cycle.

When abnormality such as jamming of paper P occurs midway along path 526, this can be detected by jamming display and the like on keyboard 310. Thereafter, the operator opens the panel and the like on the side surface of the microfilm reader printer, and then pivots frame 54 about shaft 58 to open it. The operator can thus perform maintenance such as removal of paper P in path 526.

A second embodiment of the present invention will be described below with reference to FIGS. 1 to 5 and FIGS. 9A to 11K.

In the second embodiment, the basic arrangement is the same as that of the first embodiment except that second magnetic roll $622_2$ in second developing unit $60_2$ does not require pivotal displacement through a predetermined pivoting angle. Therefore, in the second embodiment, only operations of the electrophotographic process of P → P development and N → P development will be described. Note that in the same process, the multicopying operation is denoted by symbol $_n$.

First, P → P development will be described below. As in the first embodiment, P → P development selection key 306 on operation panel 30 is depressed to set the P → P development mode. When the P → P mode is started, the surface of photoconductive drum 504 of, e.g., A-Se is uniformly and positively charged by charge transformer 648 using main charger 510 to have a surface potential of 700 V, as shown in process I' of FIG. 11A. Thereafter, in exposure process II' of FIG. 11B, projecting light (scanning light) with respect to, e.g., the positive microfilm shown in FIG. 9A is radiated on a portion of drum 504 corresponding to a portion other than character "A". Therefore, the surface potential on a portion of drum 504 corresponding to the portion other than character "A" is attenuated, and the surface potential only on a portion of drum 504 corresponding to character "A" is left. As a result, a static latent image corresponding to character "A" on the microfilm is formed. Then, a bias voltage of 400 V is applied to first developing roller $602_1$ in first developing unit $60_1$.

Figure 11A:
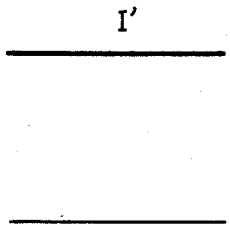
Figs. 11A to 11K are schematic views for explaining an operation according to the second embodiment of the present invention in a case of developing positive images from positive and negative films.
Figure 11B:
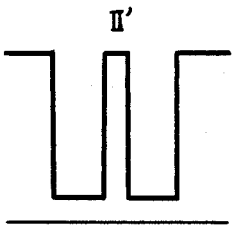
Figure 11C:
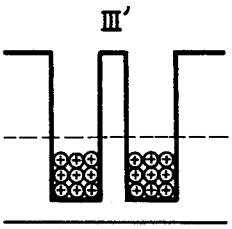

In this case, similar to the first embodiment described above, toner in unit $60_1$ is adjusted to have a positive polarity and the carrier therein is adjusted to have a negative polority. The toner transported together with the carrier along the surface of roller $602_1$ is caused to oppose the latent image on the surface of drum 504. Therefore, the toner is attracted on drum 504 by the Coulomb force, and the static latent image is visualized by reversal development, as shown in FIG. 11C (process III').

Figure 11E:
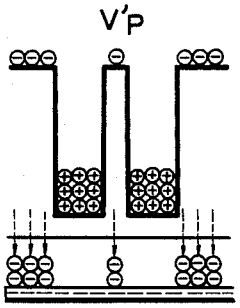
Figure 11F:
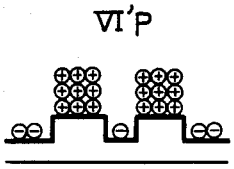
Figure 11D:
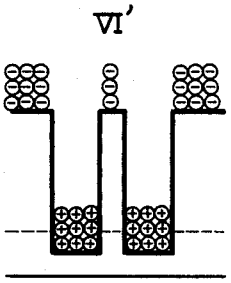

When the operation advances to process IV' (second developing process) as shown in FIG. 11D, normal development is performed contrary to the first developing process of process III'. Therefore, a developing bias of about 200 V is applied and set to second developing roller $602_2$ in unit $60_2$.

In this case, similar to the toner and carrier in unit $60_1$, the toner and the carrier in unit $60_2$ follow the triboelectrification series of both the materials such that the toner has the negative polarity and the carrier has the positive polarity. Then, normal development shown in process IV' is performed by unit $60_2$, thereby visualizing a high potential portion of the static latent image which is not visualized in process III'. Note that in normal development in process IV', soft-touch development must be performed so that the image visualized in unit $60_1$ is not disturbed and a large amount of toner is not mixed in unit $60_2$.

Paper P supplied from feed cassette 502 is synchronized by resist rollers 528 and guided to transfer charger 516, and the operation advances to transfer process $V'_P$ shown in FIG. 11E. In process $V'_P$, the toner visualized by normal development performed in process IV' described above, i.e., the toner having the negative polarity is transferred on paper P by applying a corona charge having the positive polarity of transfer charger 516 by an applied voltage of D.C. 5.4 kV by transfer transformer 650. Thereafter, paper P is separated from drum 504 by separation charger 518 and guided to heat-rollers 530. In heat-rollers 530, a transferred image is melted and fixed, and an image by P → P development is formed on paper P.

Transfer residual toner not transferred in process $V \rightarrow_P$ and toner by the N → P image visualized by unit $60_1$ of process III' are left on drum 504. The operation advances to discharging process $VI'_P$ shown in FIG. 11F while the residual toners are kept adhered on drum 504. In process $VI'_P$, light of a wavelength having sensitivity in terms of spectral sensitivity of a photoconductive body of, e.g., an LED is radiated on theresidual toners of both the transfer residual toner adhered on drum 504 and the toner in the visualized N $'_P$ image. This light is radiated on drum 504 through gaps between the individual residual toner particles to erase the static latent image on drum 504.

Thus, a process of P → P development, i.e., a copying process of one cycle is completed.

The next cycle will be described below. After process $VI'_P$, the charged corona is applied on drum 504 so that the surface potential $V_0$ thereof is uniformly charged to about 700 V, as shown in FIG. 11I. At this time, as described above, the transfer residual toner having the negative polarity is inverted to have the positive polarity since the charged corona has the positive polarity.

Therefore, in process $I'_n$, drum 504 is charged, the polarity of the transfer residual toner is inverted from negative to positive, and the toner developed by N → P development is charged toward the positive polarity up to a saturation charge amount. That is, the residual toner having the positive polarity is present on drum 504 having the surface potential of 700 V.

Figure 11G:
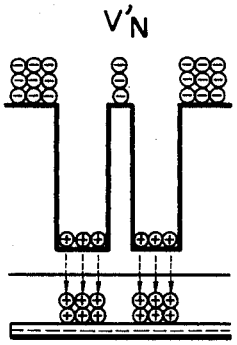
Figure 11H:
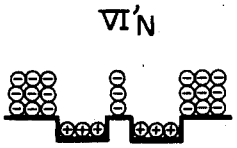
Figure 11I:
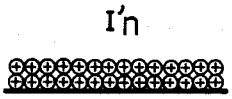
Figure 11J:
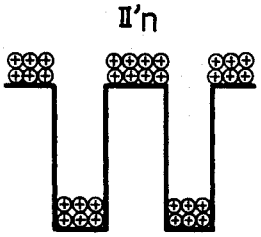

In an exposure process of process $II'_n$ shown in FIG. 11J, the surface of drum 504 is irradiated through gaps between the individual residual toner particles as in exposure of process II', thereby forming a static latent image.

Figure 11K:
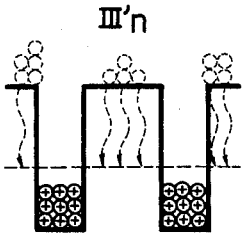

When the operation advances to a first developing process of process $III'_n$ as shown in FIG. 11K, an electric field is generated between the surface potential of 700 V of drum 504 and the bias voltage of 400 V of roller $602_1$. In this case, since both the residual toner adhered on the high potential portion of the static latent image and the surface potential of drum 504 have the positive charge, the residual toner indicated by a broken line in FIG. 11K is removed in accordance with a relationship between repulsion of the same polarity and the electric field.

The toner left on the potential attenuated portion of the static latent image is developed by fresh toner to be reversely developed in unit $60_1$ in process $III'_n$, thereby posing no problem. That is, after process $III'_n$, the operation advances to process IV', and a series of electrophotographic processes are sequentially repeated in the order of $I' \rightarrow II' \rightarrow III' \rightarrow IV' \rightarrow V'_P \rightarrow VI'P \rightarrow I'n \rightarrow II'n \rightarrow III'n \rightarrow IV'n \rightarrow V'P \ldots$, thereby outputting an image of P → P.

N → P development will be described below. Similar to P → P development, key 308 on panel 30 is depressed to set the N → P mode. In process I' of FIG. 11A, the operation is performed similar to P → P development, and in exposure of process II' in FIG. 11B, projecting light (scanning light) with respect to the negative microfilm as shown in FIG. 9B is radiated on a portion of drum 504 corresponding to character "A". Therefore, the surface potential on a portion of drum 504 corresponding to character "A" is attenuated, and the surface potential on a portion of drum 504 corresponding to a portion other than character "A" is left unchanged.

Although the operation is performed similar to P → P development in processes III' and IV' of FIGS. 11C and 11D, after visualization by unit $60_2$ in process IV', a process different from P → P development begins in process $V'_N$ of FIG. 11G.

In process $V'_N$, the corona charge having the polarity opposite to that in process $V'_P$ described above is applied on paper P by an applied voltage of about D.C. −5.0 kV using charger 650, thereby transferring an image visualized in first development of process III' on paper P.

In addition, in process $VI'_N$ shown in FIG. 11H, drum 504 is radiated and discharged by discharge lamp 520 through the residual toner, thereby attenuating the potential of drum 504, as in process $VI'_P$. After process $VI'_N$, processes are repeated similar to P → P development in accordance with processes $I'_n$, $II'_n$, and $III'_n$ described above. That is, a series of electrophotographic processes in N → P development are sequentially repeated in the order of $I' \rightarrow II' \rightarrow III' \rightarrow IV' \rightarrow V'_N \rightarrow VI'N \rightarrow I'n \rightarrow IV'n \rightarrow III'n \rightarrow IV' \rightarrow V'N \ldots$, thereby outputting an image of N → P development.

As described above, when drum 504 is repeatedly used, only processes $V'_P$ and $V'_N$ shown in Figs. 11E and 11G must be performed under the condition such that a polarity of the transfer corona is properly selected when P → P or N → P is actually selected.

Therefore, images respectively visualized by reversal development in unit $60_1$ and by normal development in unit $60_2$ before the transfer process are subjected to the transfer process by selecting N → P development or P → P development. As described above, in order to obtain an image of P → P development, polarities of the toner of N → P development and the transfer residual toner of P → P development are matched with each other by main charger 510, and these toners are removed by unit $60_1$.

On the contrary, in the case of N → P development, polarities of the toner of P → P development and the transfer residual toner of N → P development are matched with each other, and these toners are removed by unit $60_1$.

As described above, unit $60_1$ serves to remove toner and visualize an image of N → P development by reversal development and must use toner having the same polarity as that of the corona charge of charger 510. Therefore, normal development for outputting an image of P → P development in unit $60_1$ has a polarity opposite to the corona charge of main charger 510. Even when the residual toner is inverted by the corona charge to have the polarity as that of the corona charge and the residual toner adhered on the high potential portion of drum 504 is removed, the residual toner has the polarity opposite to the toner in the developing unit.

Note that in this embodiment, a microfilm reader printer is exemplified as an electrophotography apparatus, but the present invention can be used to output a reversed image of a document in an intelligent copying machine and the like.

What is claimed is:

1. An apparatus for forming a positive image on a recording medium from a positive or negative original image, comprising:

means for designating a type, positive or negative, of an original image;

a movable image carrier for carrying an electrostatic latent image and a developed image formed by a developing agent at positions corresponding to the latent image;

a plurality of electrophotographic process means positioned along a moving direction of said movable image carrier, said electrophotographic process means including;

(a) charging means for uniformly charging said image carrier to a first potential of a first polarity;

(b) a first exposing means for forming a first latent image, the first exposing means being operable when the positive image is formed from the negative original image;

(c) a first developing means having a developing agent of the first polarity for developing an electrostatic latent image of the negative original image and being applied with a second potential of the first polarity, which is lower than the first potential of the first polarity;

(d) a second exposing means for forming a second latent image, the second exposing means being operable when the positive image is formed from the positive original image:

(e) a second developing means having a developing agent of a second polarity for developing an electrostatic latent image of the positive original image and being applied with a third potential of the first polarity, which is lower than the second potential of the first polarity;

(f) transferring means for transferring an image developed either by said first or second developing means onto a recording medium by applying a transferring potential of polarity which is determined in accordance with the polarity of the developing agent carried on said movable image carrier; and (g) discharging means for uniformly lowering a potential of the movable image carrier to a given potential lower than the first potential given by said charging means;

wherein said charging means, first exposing means, first developing means, second exposing means, second developing means, transferring means and discharging means are arranged in the order mentioned along a moving direction of said movable image carrier; and, said apparatus further comprising means for controlling said plurality of electrophotographic process means so that, when said positive original image is designated, said first exposing means is not driven and said second exposing means is driven to form the electrostatic latent image corresponding to the positive original image on said movable image carrier, said first developing means is not driven and said second developing means is driven, and said transferring means is driven to transfer the developing agent of the opposite polarity carried on the movable image carrier onto the recording medium, whereby the opposite polarity of a residual developing agent not transferred onto the recording medium by said transferring means is changed to the first polarity at said charging means and is collected at said first developing means, and so that, when negative original image is designated, said first exposing means is driven to form the electrostatic latent image corresponding to the negative original image on said movable image carrier, said first developing means is driven, and said transferring means is driven to transfer the first developing agent carried on the movable image carrier onto the recording medium, whereby a residual developing agent not transferred onto the recording medium is collected at said first developing means.

2. An apparatus according to claim 1, wherein said image carrier comprises a rotatable photoconductive drum.

3. An apparatus according to claim 1, wherein each of said first and second developing agents comprises a carrier and a toner having different polarities in a triboelectrification series.

4. An apparatus according to claim 3, wherein said toners are located at the same position in the triboelectrification series, have an electron donor property with respect to the carrier of said first developing agent, and have an electron acceptor property with respect to the carrier of said second developing agent.

5. A method according to claim 1, wherein said first potential of the first portion of said static latent image is lower than said second potential of the second portion thereof.

6. A method according to claim 5, wherein said first portion of the static latent image is subjected to reversal development for visualizing the first portion of the low potential.

7. A method according to claim 5, wherein said second portion of the static latent image is subjected to normal development for visualizing the second portion of the high potential.

8. A method according to claim 7, wherein said steps of supplying the first and second developing agents are respectively performed by two-component magnetic brush developing means each having a two-component developing agent.

9. A method according to claim 8, wherein each of said two-component developing agents comprises a carrier and a toner having a different polarities in a triboelectrification series.

10. A method according to claim 9, wherein said toners are located at the same position in the triboelectrification series, have an electron donor property with respect to the carrier of said first developing agent adhered on the low potential portion, and have an electron acceptor property with respect to the carrier of said second developing agent adhered on the high potential portion.

11. An apparatus for forming a positive image on a recording medium from a positive or negative original image, comprising:

means for designating a type, positive or negative, of an original image;

a movable image carrier for carrying an electrostatic latent image and a developed image formed by developing agent at positions corresponding to the latent image;

a plurality of electrophotographic process means positioned along a moving direction of said movable image carrier, said electrophotographic process means having;

(a) charging means for uniformly charging said image carrier to a first positive potential;

(b) a first exposing means for forming a first latent image, the first exposing means being operable when the positive image is formed from the negative original image;

(c) a first developing means having a developing agent of positive polarity for developing an electrostatic latent image of the negative original image and being applied with a second positive potential which is lower than the first positive potential;

(d) a second exposing means for forming a second latent image, the second exposing means being operable when the positive image is formed from the positive original image:

(e) a second developing means having a developing agent of negative polarity for developing an electrostatic latent image of the positive original image and being applied with a third positive potential which is lower than the second positive potential;

(f) transferring means for transferring an image developed either by said first or second developing means onto a recording medium by applying a transferring potential of polarity which is determined in accordance with the polarity of the developing agent carried on said movable image carrier; and (g) discharging means for uniformly lowering a potential of the movable image carrier to a positive potential lower than the first positive potential given by said charging means;

wherein said charging means, first exposing means, first developing means, second exposing means, second developing means, transferring means and discharging means are arranged in the order mentioned along a moving direction of said movable image carrier; and said apparatus further comprising means for controlling said plurality of electrophotographic process means so that, when said positive original image is designated, said first exposing means is not driven and said second exposing means is driven to form the electrostatic latent image corresponding to the positive original image on said movable image carrier, said first developing means is not driven and said second developing means is driven, and said transferring mean is driven to transfer a negative developing agent carried on the movable image carrier onto the recording medium, whereby a polarity of a negative residual developing agent not transferred onto the recording medium by said transferring means is changed to the positive polarity at said charging means and is collected at said first developing means, and so that, when said negative original image is designated, said first exposing means is driven to form the electrostatic latent image corresponding to the negative original image on said movable image carrier, said first developing means is driven, and said transferring means is driven to transfer a positive developing agent carried on the movable image carrier onto the recording medium, whereby a polarity of a positive residual developing agent not transferred onto the recording medium is collected at said first developing means.

12. An apparatus for forming a positive image on a recording medium from a positive or negative original image, comprising:

means for designating a type, positive or negative of an original image;

a movable image carrier for carrying an electrostatic latent image and a developed image formed by developing agent at positions corresponding to the latent image;

a plurality of electrophotographic process means positioned along a moving direction of said movable image carrier, said electrophotographic process means having;

(a) charging means for uniformly charging said image carrier to a first positive potential;

(b) exposing means for selectively forming a first latent image and a second latent image according to the positive and negative original images, respectively;

(c) a first developing means having a developing agent of positive polarity for developing the first electrostatic latent image of the negative original image and being applied with a second positive potential which is lower than the first positive potential;

(d) a second developing means having a developing agent of negative polarity for developing the second electrostatic latent image of the positive original image and being applied with a third positive potential which is lower than the second positive potential;

(e) transferring means for transferring an image developed either by said first or second developing means onto a recording medium by applying a transferring potential of polarity which is determined in accordance with the polarity of the developing agent carried on said movable image carrier; and (f) discharging means for uniformly lowering a potential of the movable image carrier to a positive potential lower than the first positive potential given by said charging means;

wherein said charging means, exposing means, first developing means, second developing means, transferring means and discharging means are arranged in an order mentioned along a moving direction of said movable image carrier; and said apparatus further comprises means for controlling said plurality of electrophotographic process means so that, when said positive original image is designated, said exposing means is driven to form the first electrostatic latent image corresponding to the positive original image on said movable image carrier, said first developing means is driven and said second developing means is driven, and said transferring mean is driven to transfer a negative developing agent carried on the movable image carrier onto the recording medium, whereby a polarity of a negative residual developing agent not transferred onto the recording medium by said transferring means is changed to the positive polarity at said charging means and is collected at said first developing means, and so that, when said negative original image is designated, said exposing means is driven to form the second electrostatic latent image corresponding to the negative original image on said movable image carrier, and both of said first and second developing means are driven, and said transferring means is driven to transfer a positive developing agent carried on the movable image carrier onto the recording medium, whereby a positive residual developing agent not transferred onto the recording medium is collected at said first developing means.

13. An apparatus for forming a positive image on a recording medium from a positive or a negative original image, comprising:

a movable photo-conductive drum capable of carrying an electrostatic latent image on its surface;

a plurality of electrophotographic processing means located abut the drum;

a main charger for charging the photoconductive drum, thereby enabling the drum to form a first or second static latent image at a first or a second exposure radiating position; the first or second exposures being selectively operated depending on whether the original image is a positive or a negative film;

the image formed at the first exposure radiation portion being reverse developed by a first developing unit; and means for changing the polarity of any residual negative toner on the drum, so that toner remaining on the drum is collected by the first developing unit.

14. A method for forming a positive image from a positive or a negative original image, comprising the steps of:

designating a type, positive or negative, of an original image;

uniformly charging a movable image carried to a first potential of a first polarity;

forming a first latent image on said movable image carrier when the positive image is formed from the negative original image, said first latent image is formed from the negative original image, said first latent image having first portion of a first potential and a second portion of a second potential different from that of the first potential in accordance with the original image;

developing an electrostatic latent image of the negative original image by using one of a first and a second developing agent applying with a second potential of the first polarity, which is lower than the first potential of the first polarity;

forming a second latent image on said movable image carrier, when the positive image is formed from the positive original image:

developing an electrostatic latent image of the positive original image and applying with a third potential of the first polarity, which is lower than the second potential of the first polarity;

transferring an image developed on said movable image carried onto a recording medium by applying a transferring potential of polarity which is determined in accordance with the polarity of the developing agent carried on said movable image carrier; and uniformly charging the movable image carrier to a given potential lower than the first potential given by said charging means;

wherein said charging, first exposing, first developing, second exposing, second developing, transferring and discharging steps are performed in the order mentioned along a moving direction of said movable image carrier;

said method further comprises the steps of controlling said plurality of electrophotographic processing steps so that, when said positive original image is designated, said first exposing step is not performed and said second exposing step is performed to form the electrostatic latent corresponding to the positive original image on said movable image carrier, said first developing step is not performed and said second developing step is performed, and said transferring step is performed to transfer developing agent of the opposite polarity carried on the movable image carrier onto the recording medium, whereby the opposite polarity of a residual developing agent not transferred onto the recording medium by said transferring step is changed to the first polarity at said charging step and is collected at said first developing step, and so that, when said negative original image is designated, said first exposing step is performed to form the electrostatic latent image corresponding to the negative original image on said movable image carrier, said first developing is driven, and said transferring steps is performed to transfer the first developing agent carrier ont he movable image carrier onto the recording medium, whereby a residual developing agent not transferred onto the recording medium is collected at said first developing step.

* * * * *